US005109216A

United States Patent [19]

Yarbrough et al.

[11] Patent Number: 5,109,216

[45] Date of Patent: * Apr. 28, 1992

[54] PORTABLE INTRUSION ALARM

[75] Inventors: Alfred E. Yarbrough; Jerry O. Ball, both of Fort Worth, Tex.

[73] Assignee: Burnett Oil Co., Inc., Fort Worth, Tex.

[ * ] Notice: The portion of the term of this patent subsequent to Aug. 1, 2006 has been disclaimed.

[21] Appl. No.: 553,805

[22] Filed: Jul. 18, 1990

[51] Int. Cl.[5] ..... G08B 13/20

[52] U.S. Cl. ..... 340/544; 340/522; 340/566

[58] Field of Search ..... 340/544, 521-522, 340/566, 545; 367/136

[56] References Cited

U.S. PATENT DOCUMENTS 3,543,261 11/1970 Burney ..... 340/566 X
4,195,286 3/1980 Galvin ..... 340/522 X
4,209,776 6/1980 Frederick ..... 340/566 X
4,437,089 3/1984 Achárd ..... 340/522 X
4,668,941 5/1987 Davenport et al. ..... 340/566 X
4,853,677 8/1989 Yarbrough et al. ..... 340/544

FOREIGN PATENT DOCUMENTS 0070224 1/1983 European Pat. Off. ..... 340/566

*Primary Examiner*—Jin F. Ng
*Assistant Examiner*—Thomas J. Mullen, Jr.
*Attorney, Agent, or Firm*—Finnegan, Henderson, Farabow, Garrett and Dunner

[57] ABSTRACT

An intrusion alarm system, for an enclosed space responsive to first frequencies in the one to two Hertz range for detecting opening of doors or windows; and responsive to second frequencies in the third to four Khz range for detecting breaking glass. A mode selector renders the alarm responsive to a selected one of either the first or the second frequencies, or the concomitant detection of both first and second frequencies.

20 Claims, 6 Drawing Sheets

PORTABLE INTRUSION ALARM

FIELD OF THE INVENTION

The present invention relates to intrusion alarms; and more particularly, to a portable intrusion alarm for indicating the violation of an enclosed space.

BACKGROUND INFORMATION

Personal portable, intrusion alarm devices have become relatively popular in recent years. They can be used in one's permanent place of abode, in place of, or as a supplement to a permanently installed alarm system. Such portable alarm devices are widely used to provide a warning of unauthorized intrusion in places other than one's permanent home, such as hotel rooms, vacation homes, motor homes and boats, to mention a few examples.

There are several different types of intrusion alarm systems. Some have sensors that are fastened to a door or window which sound an alarm when the door is opened or the window raised. These systems typically require that the sensors be properly installed or attached to the window or door as the case may be. Other systems utilize electromagnetic fields or ultrasonic transducers, for example, that detect the presence of a person in the room. This type of system is also effective for certain applications, but only in areas where persons or animals are not normally present.

More recently, portable systems have been proposed that are sensitive to noise and/or to changes in ambient air pressure. Such systems have been found effective for certain applications but tend to be prone to false alarms, such as those caused by traffic noises, barking dogs, or other unexpected, but harmless, noises, for example.

SUMMARY OF THE INVENTION

One of the advantages of the present invention is to provide a portable intrusion alarm system that requires no installation of sensors in the space being monitored.

Another advantage of the present invention is to provide such an intrusion alarm system that responds both to the low frequency pressure changes caused by the opening of doors and windows in accessing the monitored area, and to the high frequency pressure changes of breaking glass, while remaining unresponsive to normal, non-intrusive sounds.

A further advantage of the present invention is to provide an intrusion alarm that is capable of activating a discernible alarm upon the detection of either one of the low frequency or the high frequency pressure changes as well as being capable of activating the discernible alarm only in response to the concomitant detection of both the low and high frequency pressure changes.

A still further advantage of the present invention is to provide an intrusion alarm system that is versatile in its application and operation.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims.

To achieve the objects and in accordance with the purpose of the invention, as embodied and broadly described herein, the portable intrusion alarm system comprises a microphone operative to detect changes in atmospheric pressure, low-frequency filter means responsive to the detected atmospheric pressure changes operative to generate an output at times when the frequency of the pressure changes correspond to the opening of either a door or window; first circuit means responsive to the output of the first low-frequency means operative to generate a first output signal upon the detected pressure changes reaching a first predetermined threshold; high frequency filter means responsive to the detected atmospheric pressure changes operative to generate an output at times when the frequency of the detected pressure changes correspond to the sound of breaking glass; second circuit means responsive to the output of the high frequency filter means operative to generate a second output signal upon the detected pressure changes reaching a second selected threshold; and alarm circuit means responsive to the concomitant generation of both the first and second output signals for providing a discernible alarm.

In another aspect, the alarm circuit means includes means for selectively activating a discernible alarm in response to the generation of a selected one of the first and second output signals singly, or the generation of both the first and second output signals concomitantly.

In still another aspect, such an alarm system further comprises a sensitivity circuit responsive to low frequency pressure changes for decreasing the level of detection of the high frequency pressure change.

The accompanying drawings, which are incorporated in and constitute a part of this specification, illustrate one embodiment of the invention and, together with the description serve to explain the principles of the invention.

DETAILED DESCRIPTION OF THE PREFERRED EMBODIMENT

Reference will now be made in detail to the present preferred embodiment of the present invention, which is an improvement in our invention described in U.S. Pat. No. 4,853,677 issued on Aug. 1, 1989.

Figure 1:
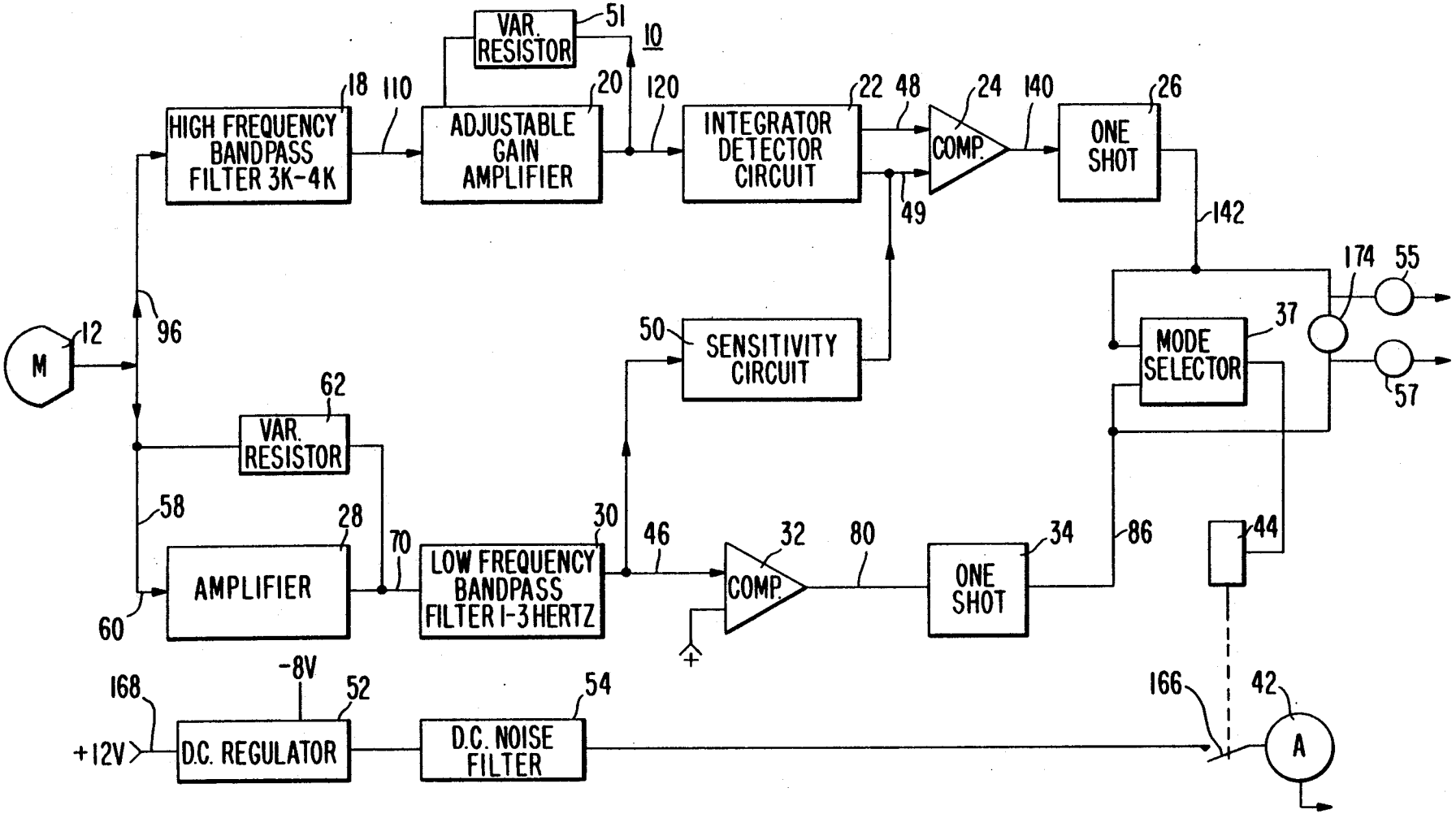
FIG. 1 is a schematic block diagram of a portable intrusion alarm system in accordance with a preferred embodiment of the present invention.
Figure 2A:
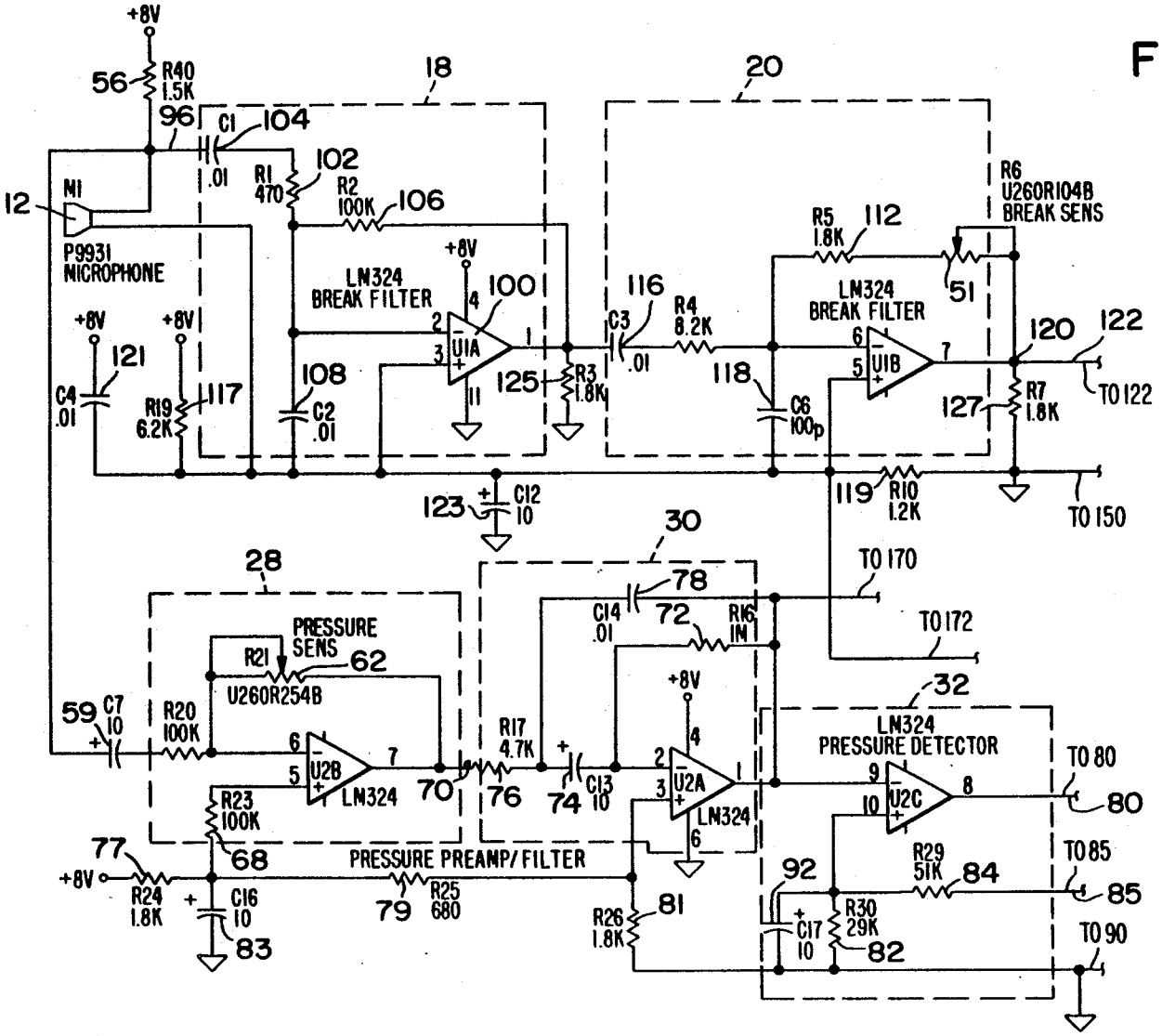
FIG. 2 is a detailed circuit diagram of the intrusion alarm system of FIG. 1.
Figure 2B:
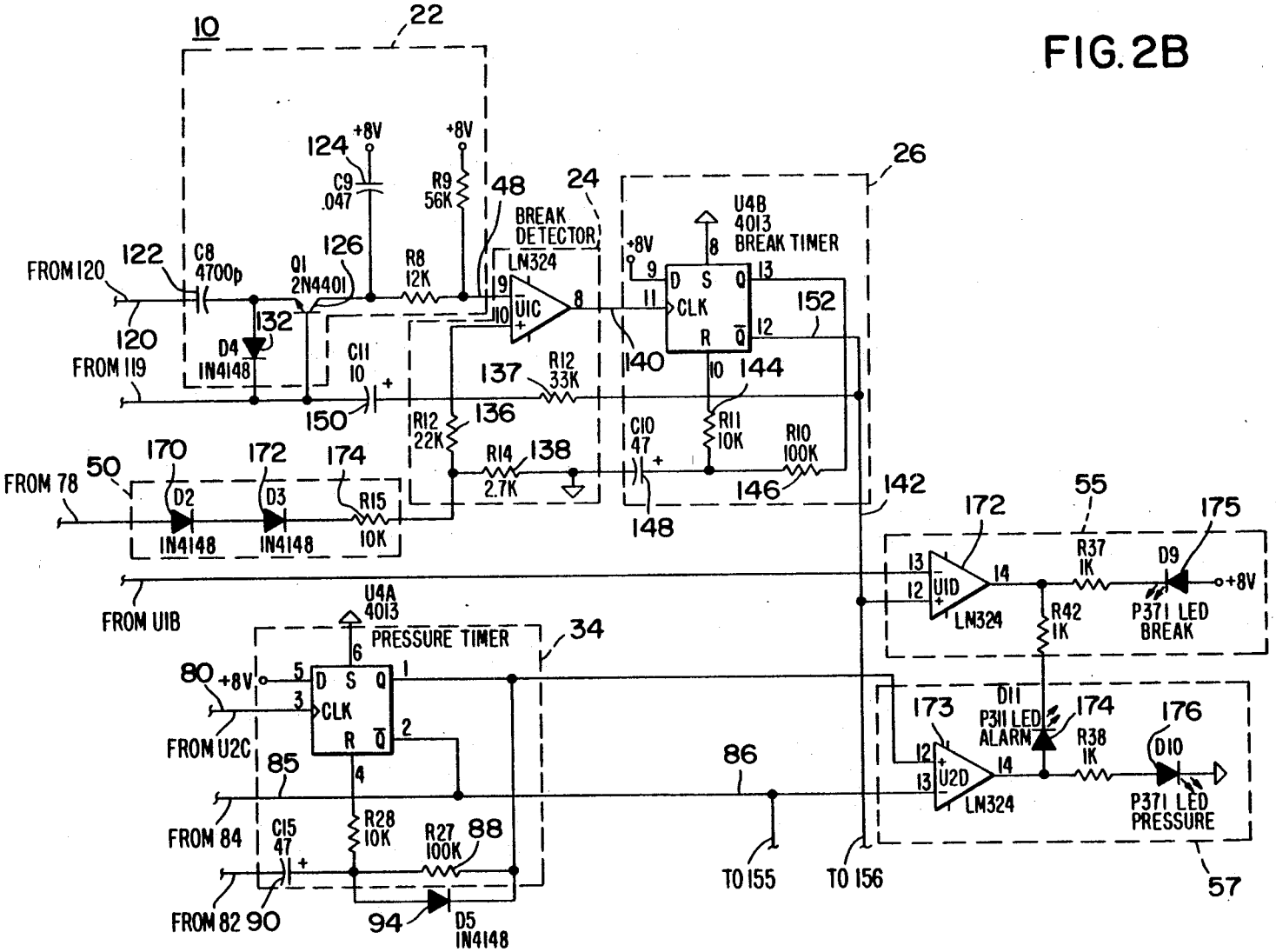
Figure 2C:
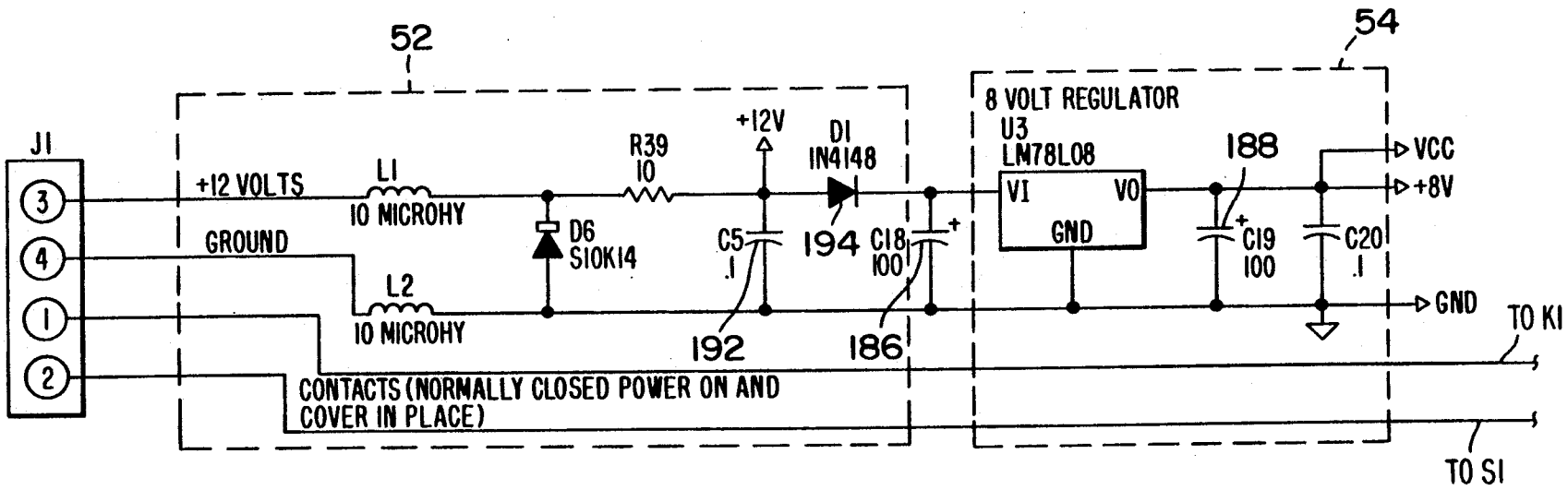
Figure 2D:
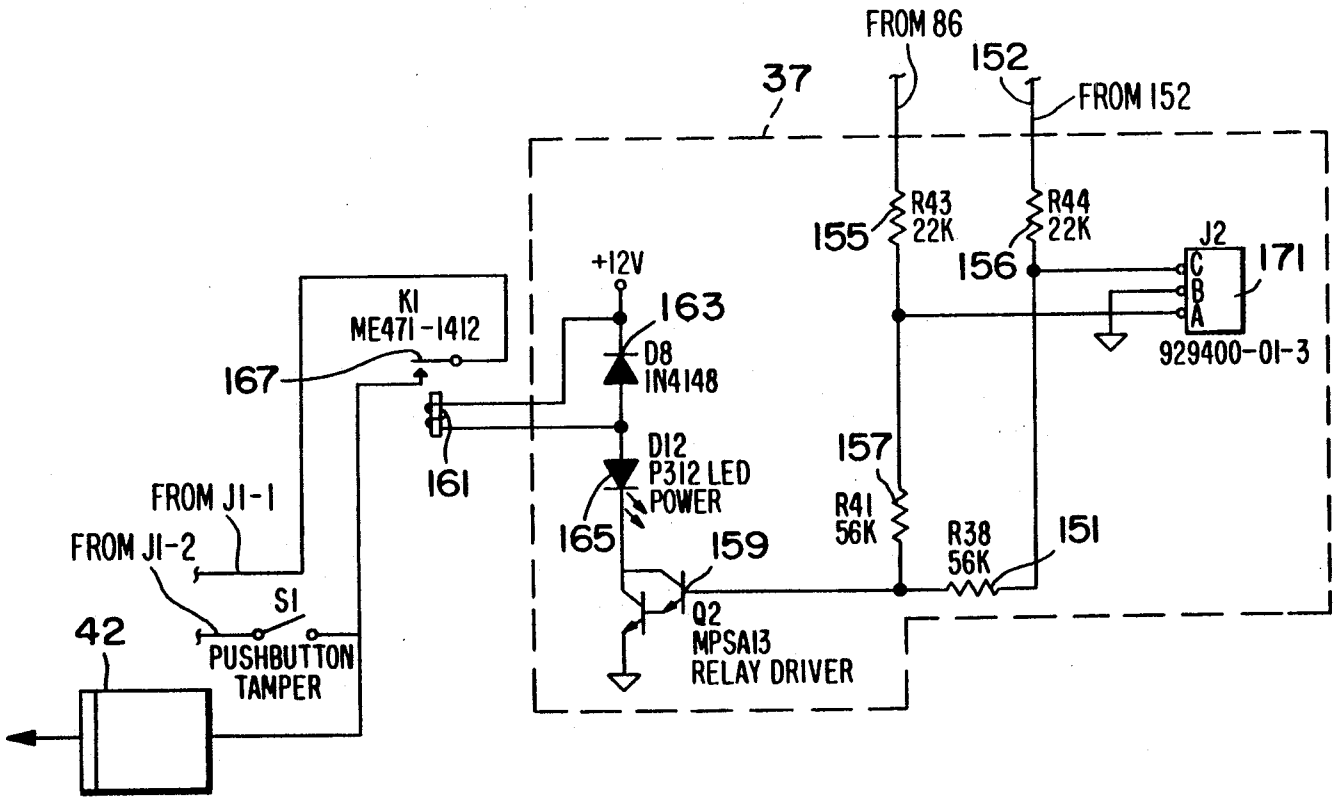

A preferred embodiment of the portable intrusion alarm system is shown in FIGS. 1 and 2, and is represented generally by the numeral 10. Referring to the schematic block diagram of FIG. 1, alarm system 10 comprises a microphone 12, the output of which is divided into two parallel connected signal paths. Constituting one path is a high frequency bandpass filter circuit 18, an adjustable gain amplifier circuit 20, an integrator/detector circuit 22, a comparator circuit 24, and a one-shot multivibrator 26. The other path constitutes an amplifier 28, a low-frequency bandpass filter circuit 30, a comparator circuit 32, and a one-shot multivibrator 34. The two paths form inputs a mode selection circuit 37, the output of which controls an alarm 42 through a relay 44. Mode selector 37 energizing alarm 42 in response to the output of a selected one or both of the one-shot multivibrators 26 and 34. Although not required for certain applications of the present invention, a sensitivity circuit 50, preferably extends between output 46 of low-frequency bandpass filter circuit 30 and output 48 of integrator/detector circuit 22. A twelve volt source energizes alarm 42, and an eight volt source energizes the various aforementioned circuits through DC voltage regulator 52 and a DC noise filter 54. A variable resistor 51 is connected across amplifier 20 and a variable resistor 62 is connected across amplifier 28. An indicator 55 is connected to output of one-shot multivibrator 26, and an indicator 57 is connected to output of one-shot multivibrator 34.

In accordance with the present invention, system 10 comprises a microphone operative to detect changes in ambient atmospheric pressure. As herein embodied, and referring also to the detailed circuit diagram of FIG. 2, microphone 12, is preferably an omni-directional condenser type which has a high sensitivity, and signal-to-noise ratio, and is capable of detecting changes in air pressure from less than one cycle per second or one Hertz to in excess of four thousand cycles per second or 4K Hertz. Bias current for the microphone is provided from an eight volt source through resistor 56. Such a microphone is well known, and is generally available from several manufacturers including *Mouser Electronics* of Mansfield, Tex.

The present invention also provides for a low frequency filter means responsive to detected ambient or atmospheric, pressure changes operative to generate an output at times when the detected pressure changes have a frequency corresponding to the opening of either a window or door. As embodied herein microphone 12 has an output 58, which is connected through capacitor 59 to input 60 of amplifier 28. Capacitor 59, which isolates the DC signal on the microphone from the circuitry of amplifier 28, but is sufficiently high in capacity, such as 10 MF, to effectively couple the low frequencies of interest. Amplifier 28 is provided to amplify the low level signal from microphone 12 and includes a variable resistor 62, which may have a maximum resistance of 470K, so that the sensitivity of amplifier 28 to the microphone may be adjusted over a substantially wide range. Resistors 64, 66, and 68 which are each 100K, set the minimum sensitivity level of the amplifier. The amplified signal is applied to input 70 of low frequency bandpass filter 30 to output detected frequencies in the one and two Hertz range as shown by waveform 19 of FIG. 3. A resistor/capacitor circuit, which may comprise a one megohm resistor 72 and a 10 Mf capacitor 74 sets the low frequency cut-off of filter 30. An RC circuit, which may comprise a 4.7K resistor 76 and a one Mf capacitor 78, sets the high frequency cut-off. Resistor 77, which may be 1.8K, resistor 79, which may be 680 ohms, and resistor 81, which may be 1.8 ohms, constitute a voltage divider for setting the correct operating points for amplifier 28 and low frequency filter 30. Capacitor 83, which has a value of 47 Mf, is a noise filter that requires a large value because of the low frequencies involved.

The invention includes a first circuit means responsive to the output of the low frequency filter operative to generate a first output signal upon the detected pressure change reaching a predetermined threshold. In the preferred embodiment illustrated herein, the first circuit means comprises comparator circuit 32 having its input connected to output 46 of filter 30; and a one-shot multivibrator 34 connected to output 80 of comparator circuit 32. When the voltage level on output 46 of filter circuit 30 decreases by a predetermined amount below the set level as determined by resistors 82 and 84, an output signal appears on output 80, which causes one-shot 34 to generate a single pulse on output 86. The width of the single pulse is determined by RC circuit resistor 88, which may be 100K, and capacitor 90, which may be 47 Mf. Capacitor 92 eliminates noise, and may have a value of 10 Mf. The output from comparator 32 on line 85 is applied through resistor 84 preventing any further alarm trips during the pulse time. Diode 94 discharges capacitor 90 after a predetermined delay, which resets one-shot 34 in readiness for another detection.

In accordance with the present invention, a high frequency filter means responsive to the detected atmospheric pressure change is operative to generate an output at times when the frequency of the detected pressure change corresponds to the sound of breaking glass. As embodied herein, output 96 of microphone 12, which is connected in parallel with output 58, serves as the input to high frequency bandpass filter 18. Filter 18 is centered around a frequency of three to four KHz to isolate the noise of breaking glass. Operational amplifier 100 replaces the signal lost in the filtering process. High frequency cut-off is determined by RC circuit comprising a 470K resistor 102 and a 0.01 Mf capacitor 104. Low frequency cut-off is determined by a 100K resistor 106 and a one Mf capacitor 108.

Filter 18 is connected at its output 110 to adjustable gain amplifier 20, which boosts the signal on 110 to a level sufficient to drive integrator detector circuit 22. Resistor 112, which may be 22K, sets the minimum gain and variable resistor 51, which has a maximum resistance of 470K, adjusts the gain of the amplifier for varying the sensitivity of the amplifier to the filtered frequencies. A 0.01 Mf capacitor 116 and a 100 PF capacitor 118 eliminate high frequencies that could cause false alarms. Resistor 117, which may be 3.3K, and resistor 119, which may be 680 ohms, constitute a voltage divider that sets the operating point of integrator/detector circuit 22. Capacitor 121 and 123 filter the set point to minimize the effect of noise. The capacitors may have a value of 0.01 Mf and 47 Mf, respectively. One kilohm resistors 125 and 127 add stability by keeping the output impedance of filter 18 and amplifier 20 low.

Figure 3:
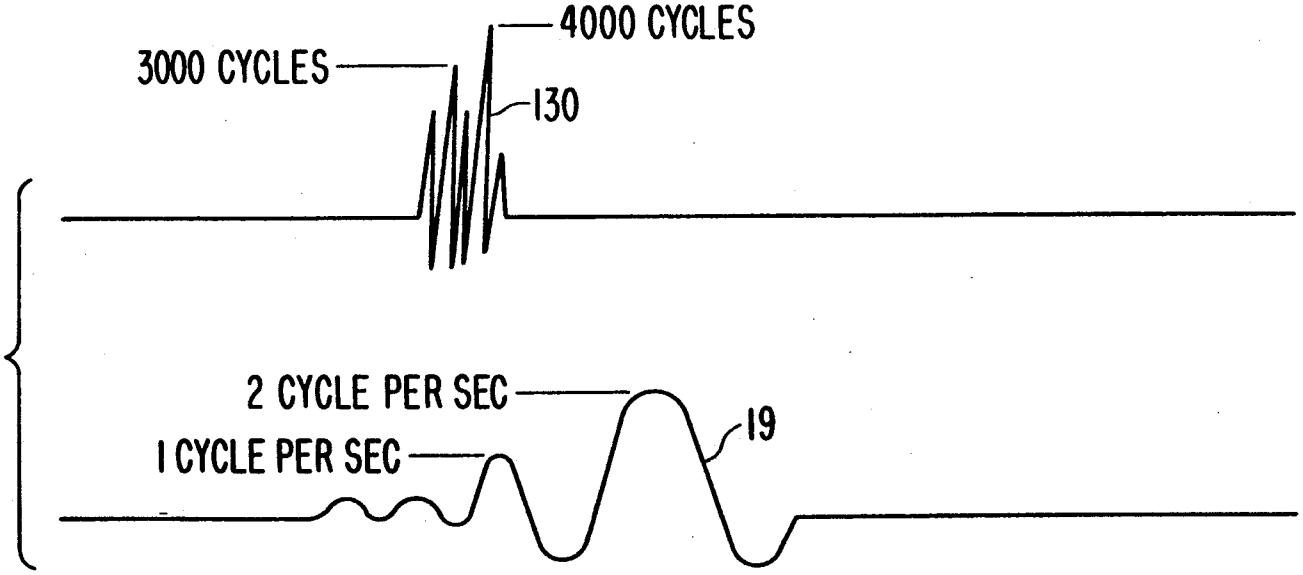
FIG. 3 is a graphical illustration of the output of the bandpass filters of FIGS. 1 and 2.

In accordance with the invention, alarm system 10 comprises a second circuit means responsive to the output of the high frequency filter means operative to generate a second output signal upon the detected pressure changes attaining a second predetermined threshold. As embodied herein, the second circuit means includes integrator/detector circuit 22, which is coupled to amplifier 20 by line 120. Circuit 22 has a capacitor 122 at the input thereof, which may be 4700 Pf, and is normally charged. Each impulse from amplifier 20 on line 120 causes a portion of the charge on capacitor 122 to be transferred to capacitor 124, which in the described embodiment has a value of 47 Mf, through isolation transistor 126. Transistor 126 may be a 2N4401 type. The amount of the charge that is transferred is dependent on the strength and duration of the signal from amplifier 20, which is adjustable by resistor 51; and of course, is limited by the amount of charge capacitor 124 can hold. After capacitor 124 is saturated, further impulses from amplifier 20 will provide a signal to comparator 24 of the proper level. Thus, a single impulse from amplifier 20 will not affect the output of the circuit 22. Several impulses are required similar to those obtained when clicking a fingernail over the teeth of a comb. As shown by FIG. 3 waveform 30 resembles breaking glass. Diode 132 limits the effect of positive going impulses from amplifier 20. The second circuit means also includes comparator 24 connected to output 48 of detector circuit 22. When the signal on line 48 goes below the level set by resistors 134, 136, and 138, which may have values of 33K, 22K, and 2.7K, respectively, an output signal is applied to one-shot multivibrator 26 on line 140. One shot multivibrator 26 provides a single output pulse on line 142, the width of which is determined by 10K resistor 144, 100K resistor 146, and 47 Mf capacitor 148, for example. Capacitor 150 is a noise eliminator. The output on line 152 is low during the output pulse preventing any further alarm trips during the pulse time.

In accordance with the present invention, the alarm system includes mode selector circuit 37 for receiving an indication of both low frequency detection from one-shot multivibrator 24 and an indication of high frequency detection from one-shot multivibrator 26. As embodied herein, and referring to FIG. 2, mode selector circuit 37 comprises resistors 151 and 153 in output line 142 of one-shot multivibrator 26, resistors 155 and 157 in output line 86 of one-shot multivibrator 24, a transistor relay driver 159, comprised of a Darlington pair, a relay 161, diode 163 connected across the relay energizing winding, and a light emitting diode 165 connected between the relay winding and collector terminals of transistor 159. Mode selector 37 also comprises a terminal block 171 having pins A , B , and C . Pin A is connected to output 86 of one-shot multivibrator 34 between 22 Kilohm resistors 155 and 56 kilohm resistor 157, and pin C is connected to output 142 of one-shot multivibrator 26 between 56 kilohm resistor 151 and 22 kilohm resistor 153. Pin B is connected to ground.

When there is no low frequency or high frequency output from one-shot multivibrators 24 and 26, their respective outputs 86 and 142 are high; and Darlington pair 159 is driven to the "on" condition by the presence of low output on both lines 142 and 86, which completes a 12 v circuit through the winding of relay 161 and light emitting diode 165. This condition, with relay 161 energized and LED "on" indicates a "no-alarm" state. When terminals A and C of block 171 are connected to lines 86 and 142, each is disconnected from terminal B. Under this condition when only one of the outputs 142 or 86 go from high to low indicating the detection of a corresponding high or low frequency pressure wave, relay driver 159 still remains "on" and light emitting diode 165 remains lit indicating a "no-alarm" state. However, when both 142 and 86 go "low" concomitantly, relay driver 159 turns-off causing relay contact 167 to close, thus generating a discernible alarm.

The shorting or shunting of pins B and C of terminal block 171 connects output 142 of one-shot-multivibrator through resistor 153 to ground. This removes the high voltage output on line 142 from relay driver 159. Therefore, when output 86 goes low in response to low frequency pressure detection, relay driven 159 ceases to conduct and alarm 42 is activated. The removal of the shunt from B and C and the shunting of pins A and B connects output 86 to ground, thus leaving output 142 as the only high input to relay driver 159. Thus, when high frequency pressure detection causes 142 to go low, alarm 42 is activated. The selective shunting of pins A and B, and B and C may be accomplished by removably inserting the ends of a piece of metal in terminal openings, for example. Also, a conventional manually operable switch may be used.

LED driver circuit 55 includes comparator 172, and glass break light emitting diode 175. LED driver circuit 57 includes comparator 173, LED driver circuit 39 includes light emitting diode 174 connected across the output of comparators 172 and 175. Drive circuit provides an indication of circuit status and alarm condition. Normally the output of comparator 172 is high and the output of comparator 173 is low. Under these conditions all three of the diodes 174, 175, and 176 are off. If a high frequency glass break condition occurs, 172 will go low, turning diode 175 on. If a low frequency pressure condition occurs, comparator 173 will go high, turning diode 176 on. If both a low frequency and high frequency alarm condition exists at the same time, diode 174 will also turn on indicating the combined alarm condition.

Voltage regulator 52 supplies an eight volt potential for the various amplifier, filter and detector circuits of the alarm system. Capacitors 186 (100 mF) and 188 (47 mF) of voltage regulator circuit 54 filter noise, and prevent oscillations in the regulator. Inductances 190, and capacitor 192 (0.01), filter the input DC voltage to minimize noise effects. Diode 194 prevents damage in the event of an inadvertant reverse hook-up of the power; and resistor 196 acts like a fuse in the event of catastrophic failure in the circuit.

The amplitude of the noise of breaking of glass may be minimized by well known methods in an attempt to prevent detection, while the result of such breakage may produce the same low frequency response as opening a door or window, except with an amplitude insufficient to produce the required output signal. Thus, the alarm system of the invention preferably includes sensitivity circuit means responsive to the output of the low frequency filter means for effectively decreasing the second selected threshold.

As embodied herein, and as described in our U.S. Pat. No. 4,853,677 issued Aug. 1, 1989, sensitivity circuit 50 comprising diodes 170 and 172 and a 10K resistor 174 are connected in series between line 46, that in turn connects the output of low frequency filter 30 to comparator 32, and line 49, that constitutes the reference input to comparison circuit 24. Circuit 50 applies a portion of the low frequency pressure detection output to decrease the predetermined threshold of the signal from the integrator/detector circuit 22 to comparator 24. Thus, when a low frequency pressure wave is detected and the mode selector is set for the alarm to be activated either in response to glass break detection only, or in response to the concomitant detection of both the low frequency and high frequency pressure wave, the glass break sensitivity for shifting output 142 from high to low is increased by an amount that corresponds to the amplitude of the low frequency pressure wave. It is not necessary that the strength of the low frequency wave be sufficient to cause an alarm independent of glass breakage, since the input to sensitivity circuit 50 is the input of the comparator.

It will be apparent to those skilled in the art that various modifications and variations can be made in the alarm system of the present invention without departing from the spirit and scope of the invention. Thus, it is intended that the present invention cover the modifications and variations provided they come within the scope of the appended claims and their equivalents.

What we claim is:

1. An intrusion alarm system, comprising:

a microphone operative to detect changes in ambient atmospheric pressure;

low frequency filter means responsive to the detected ambient pressure changes operative to generate an output at times when the frequency of the pressure changes correspond to the opening of either a door or window;

first circuit means responsive to the output of the low frequency filter means operative to generate a first output signal upon the detected pressure changes reaching a first predetermined threshold;

high frequency filter means responsive to the detected atmospheric pressure changes operative to generate an output at times when the frequency of the detected pressure changes correspond to the sound of breaking glass;

second circuit means responsive to the output of the high frequency filter means operative to generate a second output signal upon the detected pressure changes reaching a second predetermined threshold; and alarm means responsive to the concomitant presence of both the first and second output signals for generating a discernible alarm.

2. The system of claim 1 wherein the alarm means includes mode selecting means for generating the alarm in response to a selected one of the first and second output signals only.

3. The system of claim 1 further comprising sensitivity circuit means responsive to the output of one of the low frequency and high frequency filter means for varying the threshold of the other of the low frequency and high frequency filter means.

4. The system of claim 1 further comprising driver circuit means having a first alarm indicator responsive solely to the generation of the first output signal indicating a low frequency pressure wave; a second alarm indicator responsive solely to the generation of the second output signal indicating a high frequency pressure wave; and a third alarm indicator responsive to the concomitant presence of both the first and second output signals.

5. The system of claim 4 wherein the first, second, and third alarm indicators are light emitting diodes.

6. The system of claim 1 further comprising first adjustable gain amplifier means for varying the output of the high frequency filter means, and second adjustable gain amplifier means for varying the input to the low frequency filter means.

7. The system of claim 6 further comprising sensitivity circuit means responsive to the output of the low frequency filter means for varying the amplitude of the output of the high frequency filter means to which the second circuit means responds.

8. The system of claim 1 further comprising sensitivity circuit means responsive to the output of the low frequency filter means for varying the required amplitude of the output of high frequency filter means to which the second circuit means responds.

9. The alarm system of claim 1 wherein the low frequency filter means is a bandpass filter having a low cut-off frequency of approximately less than one Hertz and a high cut-off frequency of approximately two Hertz.

10. The alarm system of claim 1 wherein the high frequency filter means is operative to generate an output at times when the frequency of the pressure changes are in the range of approximately 3K to 4K Hertz.

11. The alarm system of claim 1 wherein the second circuit means, comprises capacitance means operative when charged a plurality of times in succession to generate the second output signal, said capacitance being charged in response to each cycle of the output of the high frequency filter means.

12. The alarm system of claim 1 wherein the first circuit means comprises, a comparator having a pair of inputs, one of said inputs being coupled to a reference voltage and another of said inputs being connected to the output of the low frequency filter means, said comparator being operative to generate the first output signal at times when the output of the low frequency filter means differs from the reference voltage by a predetermined level.

13. The alarm system of claim 1 wherein the second circuit means, comprises a comparator having a pair of inputs, one of said inputs being coupled to a reference voltage and another of said inputs being coupled to the output of the high frequency filter means, said comparator being operative to generate the second output signal at times when the output of the high frequency filter means differs from the reference voltage by a predetermined level.

14. An intrusion alarm system, comprising:

a microphone operative to detect changes in atmospheric pressure;

low frequency filter means responsive to the detected atmospheric pressure changes operative to output signals having frequencies within a selected range;

first circuit means responsive to the output of the low frequency filter means operative to generate a first output mode selection means signal upon the detected pressure changes reaching a first selected threshold;

high frequency filter means responsive to the detected atmospheric pressure changes operative to generate an output at times when the frequency of the detected pressure changes correspond to the sound of breaking glass;

second circuit means operative to generate a second output signal in response to the break signal reaching a level corresponding to a predetermined threshold; and mode selection means selectively responsive to the concomitant presence of both the first and second output signals or a selected one of the first and second output signals only for generating a discernible alarm.

15. The alarm system of claim 14 further comprising a sensitivity circuit means coupled between the output of the low frequency filter means and the high frequency filter means for varying the determined threshold of the break signal as a function of the output of the low frequency filter means.

16. The alarm system of claim 15 wherein the second filter means is operative to generate an output at times when the frequency of the pressure changes are in the range of approximately 3K to 4K Hertz.

17. The alarm system of claim 15 wherein the second circuit means, comprises capacitance means operative when charged a predetermined number of times in succession to generate the second output signal, said capacitance being charged in response to each cycle of the output of the second filter means.

18. The alarm system of claim 15 wherein the first circuit means comprises, a comparator having a pair of inputs, one of said inputs being coupled to a reference voltage and another of said inputs being connected to the output of the first filter means, said comparator being operative to generate the first output signal at times when the output of the first filter means differs from the reference voltage by a selected level.

19. The alarm system of claim 15 wherein the second circuit means, comprises a comparator having a pair of inputs, one of said inputs being coupled to a reference voltage and another of said inputs being coupled to the output of the second filter means, said comparator being operative to generate the second output signal at times when the output of the second filter means differs from the reference voltage by a selected level.

20. The alarm system of claim 14 wherein the first filter means is a bandpass filter having a low cut-off frequency of approximately less than 1 Hertz and a high cut-off frequency of approximately 2 Hertz.

* * * * *